US006932064B1

(12) United States Patent
Kolak et al.

(10) Patent No.: US 6,932,064 B1
(45) Date of Patent: Aug. 23, 2005

(54) CAPACITOR DISCHARGE IGNITION

(75) Inventors: Lewis M. Kolak, Reese, MI (US); Gerald J. LaMarr, Jr., Bay City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 10/833,354

(22) Filed: Apr. 28, 2004

(51) Int. Cl.[7] ..... F02P 3/06
(52) U.S. Cl. ..... 123/605; 123/618; 123/594
(58) Field of Search ..... 123/594, 596, 123/597, 605, 618, 406.57

(56) References Cited

U.S. PATENT DOCUMENTS

| | | | | |
|---|---|---|---|---|
| 3,554,179 | A | 1/1971 | Burson | 123/149 |
| 3,911,887 | A | 10/1975 | Burson | 123/148 |
| 3,955,549 | A | 5/1976 | Burson | 123/148 |
| 4,114,583 | A | 9/1978 | Sleder et al. | 123/148 |
| 4,982,717 | A | 1/1991 | Okuda | 123/603 |
| 5,025,498 | A | 6/1991 | Agren | 361/156 |
| 5,040,519 | A | 8/1991 | Remmers | 123/602 |
| 5,245,965 | A | 9/1993 | Andersson | 123/335 |
| 5,392,753 | A | 2/1995 | Burson et al. | 123/600 |
| 5,606,958 | A | 3/1997 | Chrintz-Gath et al. | 123/601 |
| 6,009,865 | A | 1/2000 | Herndon et al. | 123/601 |
| 6,388,445 | B1 | 5/2002 | Andersson | 324/380 |
| 6,408,820 | B1 | 6/2002 | LaMarr, Jr. | 123/406.7 |

*Primary Examiner*—Bibhu Mohanty
(74) *Attorney, Agent, or Firm*—Reising, Ethington, Barnes, Kisselle, P.C.

(57) ABSTRACT

A capacitor discharge ignition (CDI) system includes a trigger circuit that generates a trigger signal in synchronism with operation of an engine for discharging an ignition capacitor. A timing circuit is connected to the trigger circuit for controlling the timing of the trigger signal and includes a timing coil for generating a timing signal in synchronism with operation of the engine. The timing circuit further includes a switch that has primary electrodes connected to the trigger circuit and a control electrode coupled to the timing coil for shorting the trigger circuit as a function of engine speed. The CDI system is thus capable of advancing engine timing to enable low-speed startup. The timing circuit is further adaptable to provide skip-spark speed-governing, timing retard speed-governing, and anti-reverse rotation of the engine.

14 Claims, 5 Drawing Sheets

CAPACITOR DISCHARGE IGNITION

FIELD OF THE INVENTION

This invention relates generally to ignition systems and more particularly to capacitor discharge ignition systems for internal combustion engines.

BACKGROUND OF THE INVENTION

Capacitor discharge ignition (CDI) systems are widely used in spark-ignited internal combustion engines. Generally, CDI systems include a main capacitor, which during each cycle of an engine, is charged by an associated generator or charge coil and is later discharged through a step-up transformer or ignition coil to fire a spark plug. CDI systems typically have a stator assembly including a ferromagnetic stator core having wound thereabout the charge coil and the ignition coil with its primary and secondary windings. A permanent magnet assembly is typically mounted on an engine flywheel to generate current pulses within the charge coil as the permanent magnet is rotated past the ferromagnetic stator core. The current pulses produced in the charge coil are used to charge the main capacitor which is subsequently discharged upon activation of a trigger signal. The trigger signal is supplied by a trigger coil that is also wound around the stator core, wherein the permanent magnet assembly cycles past the stator core to generate pulses within the trigger coil. Upon receipt of the trigger signal, the main capacitor discharges through the primary winding of the ignition coil to induce a current in the secondary winding that is sufficient to cause a spark across a spark gap of the spark plug to ignite a fuel and air mixture within a combustion chamber of the engine. The time and occurrence of CDI is of importance to startability, output power, and emissions performance of engines, including small two and four stroke engines. Optimum ignition timing varies, primarily as a function of engine speed and engine load factors. Secondary factors, such as emissions performance and fuel quality, also play a role in determining optimum spark timing.

Microprocessor electronic timing control systems have been proposed for large engine applications, such as automotive engines, but typically are not well-suited to small engine applications because of cost and packaging constraints. Specifically, it has been proposed to employ microprocessor ignition modules in small engine applications, in which engine timing factors and desired advance or retard timing characteristics are pre-programmed into the microprocessor. For example, a microprocessor may be used to create a timing advance with increasing engine speed. However, cost constraints associated with microprocessor ignition systems are prohibitive in most small engine applications.

Moreover, in many CDI systems a somewhat high engine speed must be obtained before sufficient current pulses are generated in the charge coil and transferred to the capacitor to charge the capacitor sufficiently such that when discharged, a spark is generated across the spark gap of the spark plug. Thus, these prior ignitions systems require the engine to attain a relatively high startup speed before the ignition system is capable of producing a spark across the spark gap of the spark plug to start the engine.

Furthermore, engine overspeed is a problem in many small engine applications, such as chainsaws. It is possible for an engine to accelerate to an RPM range at which engine components and a saw blade can become damaged, such as where a load on a chainsaw is suddenly removed when the engine is operating at full throttle. Mechanical and microprocessor speed governors are typically employed to alleviate this problem, but are space-consuming and/or expensive, and often lead to unburned fuel in the engine exhaust.

Finally, it is possible during engine startup for the engine to rotate in a reverse rotational direction and for such reverse direction to be sustained after startup. Reverse startup and sustained operation may result in damage to the chainsaw and may result in a startup "kick-back" condition.

Thus, prior ignition systems are not yet fully optimized to provide a comprehensive ignition system that includes the ability to start the engine at a relatively low engine cranking speed, does not require relatively expensive microprocessor circuits, does not succumb to engine over-speed conditions, does not suffer from startup kick-back, and is of relatively simple design.

SUMMARY OF THE INVENTION

According to one aspect of the present invention, a capacitor discharge ignition (CDI) system is provided for an engine having an ignition device. The CDI system includes an ignition coil having a primary winding and a secondary winding for coupling to the ignition device. An ignition capacitor is coupled to the primary winding, and a charge coil is coupled to the ignition capacitor for generating a charge signal in synchronism with operation of the engine in order to charge the ignition capacitor. A trigger circuit generates a trigger signal in synchronism with operation of the engine and is connected in circuit with the ignition capacitor and the primary winding for discharging the ignition capacitor through the primary winding. A timing circuit is connected to the trigger circuit for controlling the timing of the trigger signal. The timing circuit includes a timing coil for generating a timing signal in synchronism with operation of the engine, and further includes a switch having primary current conducting electrodes in circuit with the trigger circuit and further having a control electrode coupled to the timing coil for shorting the trigger circuit as a function of engine speed to advance engine timing.

In accordance with a second aspect of the present invention, the trigger circuit further includes a trigger coil that generates the trigger signal, which is phased from the timing signal generated by the timing coil. Furthermore, a capacitor is connected across the timing coil so as to provide skip-spark speed-governing at relatively high engine speeds. In other words, the capacitor selectively prevents a spark ignition event at engine operating speeds above a predetermined threshold speed.

In accordance with a third aspect of the present invention, the timing circuit includes a transistor as the switch to provide timing retard speed-governing at relatively high engine speeds. In other words, the switch selectively provides timing retard at engine operating speeds above a predetermined threshold speed.

In accordance with a fourth aspect of the present invention, the timing circuit includes a capacitor operatively connected to the charge coil and to the control electrode of the second switch for disabling the trigger segment to prevent reverse rotation of the engine. A third switch has primary current conducting electrodes connected across the capacitor and further has a control electrode coupled to the timing coil, whereby the third switch discharges the capacitor to permit forward rotational operation. Accordingly, the CDI system prevents startup kick-back and reverse rotation operation of the engine.

Objects, features, and advantages of this invention include providing a capacitor discharge ignition system which improves starting of an engine, provides ignition spark at relatively low engine cranking speed, avoids use of relatively expensive microprocessor circuits, prevents overspeed operation of the engine, reduces delivery of unburned fuel to exhaust, retards engine timing at relatively high speeds, prevents ignition spark when the engine rotates in reverse to prohibit powered running in a reverse direction of rotation, is particularly well adapted for use in small two-stroke and four-stroke engine applications such as for chainsaws, is of relatively simple design and economical manufacture and assembly, and in service has a long, useful life.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENTS

Figure 1:
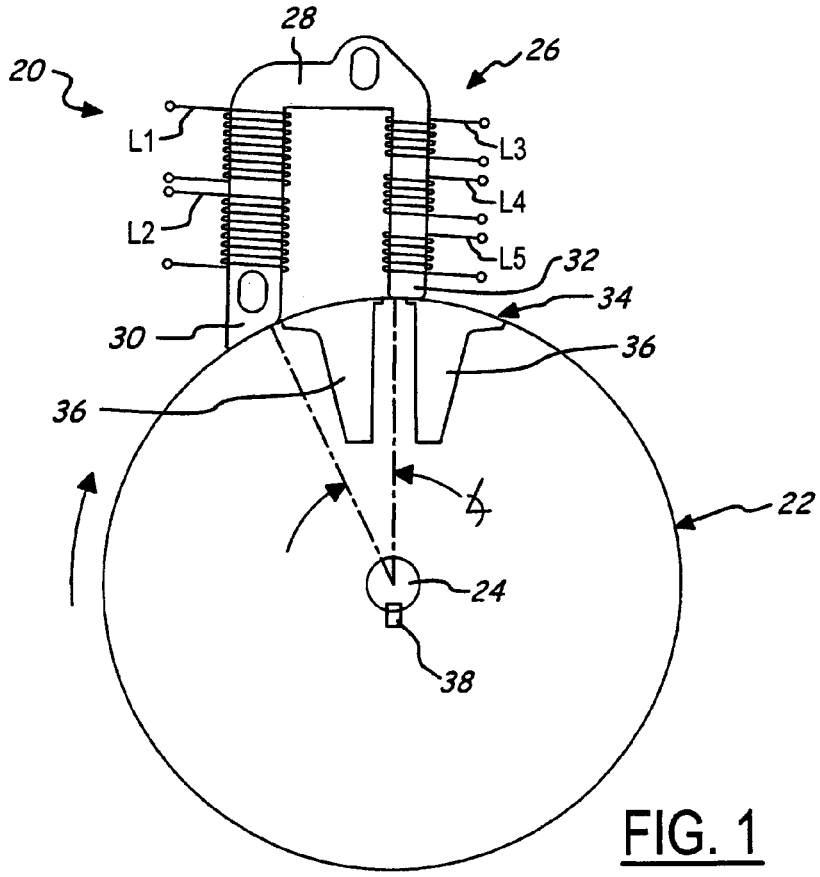
FIG. 1 is a mechanical schematic representation of portions of a capacitor discharge ignition system embodying at least a portion of the present invention and having a stator assembly mounted adjacent to a permanent magnet assembly mounted on a flywheel of an engine crankshaft.

Referring in detail to the drawings, FIG. 1 illustrates electro-mechanical magneto ignition hardware of an ignition system 20 of the present invention, which is particularly well-suited for application in two-stroke engines such as chainsaw engines. A flywheel 22 is mounted to an engine crankshaft 24, and a stator assembly 26 is positioned radially outwardly of the flywheel 22, wherein the flywheel 22 rotates with the engine crankshaft 24 past the stator assembly 26 thereby generating pulses of magnetic flux therethrough.

The stator assembly 26 includes a U-shaped ferrous armature or lamstack 28 that is composed of a stack of laminated iron plates. The lamstack 28 has first and second legs 30, 32 and is preferably mounted to a housing on an engine (not shown) leaving a measured air-gap between the stator assembly 26 and flywheel 22 on the order of about 0.3 mm/0.12 in. The stator assembly 26 further includes five coils or windings wound around the legs 30, 32 of the ferrous lamstack 28. Coil L1 is a charge coil and coil L2 is a trigger coil. Both coils L1, L2 are wound around the first leg 30 of the lamstack 28. Coil L3 is a timing coil for generating a timing signal and is wound around the second leg 32 of the lamstack 28, thereby creating a mechanical time delay between the coils L2, L3. In other words, the coils L2, L3 are preferably wound around the separate legs of the lamstack 28 to obtain a phase separation on the order of about 10 to 50 degrees, and preferably about 25 degrees. A transformer or ignition coil is defined by a primary winding L4 and a secondary winding L5, both of which are wound around the second leg 32 of the lamstack 28.

The flywheel 22 includes a permanent magnet 34 having pole shoes 36 that are rotatable in unison with the crankshaft 24. Because the flywheel 22 is preferably composed of a non-magnetic material such as aluminum, magnetic flux emitted by the permanent magnet 34 will be concentrated in the pole shoes 36 for magnetic coupling to the stator assembly 26. The permanent magnet 34 is located at a predetermined angular position relative to a key 38 that is located between, and couples, the crankshaft 24 and flywheel 22. Preferably the predetermined angular position is such that rotation of the permanent magnet 34 relative to the stator assembly 26 is in timed relation to a top-dead-center position of an engine piston (not shown) to control the timing of the ignition spark relative to the top-dead-center position of the piston. The timing of the ignition spark is preferably controlled by circuitry on a printed circuit board that is preferably carried along with the stator assembly 26.

In any case, as the engine crankshaft 24 rotates, the permanent magnet 34 rotates past the lamstack 28 and induces a magnetic field therein. This magnetic field induces a small amount of current and voltage in the coils L1, L2, L3, L4, L5 that, as will be described below, are leveraged for use in generating the ignition spark to ignite a fuel and air mixture in the combustion chamber of the engine (not shown). Typically, the energy output of a magneto apparatus is obtained in part as a result of a rapid rate of a change of magnetic flux through the ignition coil. The primary winding L4 has comparatively few turns of relatively heavy wire and the secondary winding L5 has many thousand turns of relatively fine wire, by way of example without limitation. One end of the secondary winding L5 is connected to an end of the primary winding L4 and is grounded. Circuitry is typically adapted to interrupt the primary winding L4 each time the magnetic flux therethrough is changing at its greatest rate. A resulting sudden collapse of current through the primary winding L4 tends to induce a very high voltage in the secondary winding L5, thereby creating the ignition spark.

First Preferred Embodiment

Figure 2:
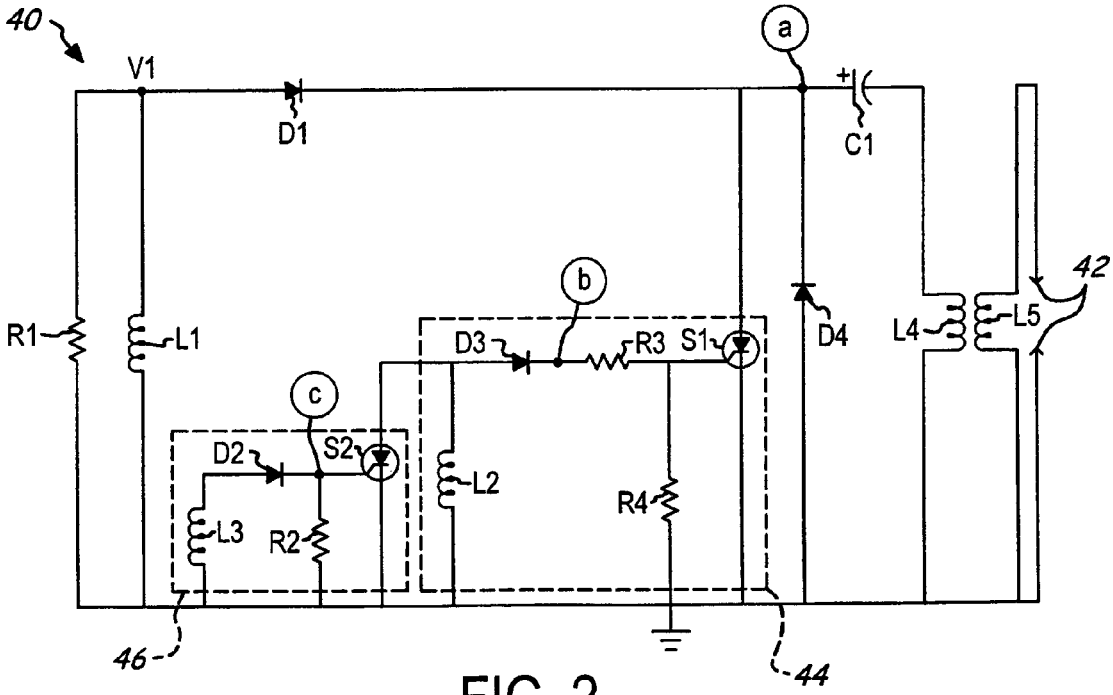
FIG. 2 is an electrical schematic diagram of an ignition circuit according to a first embodiment of the present invention.

FIG. 2 illustrates a capacitor discharge ignition (CDI) circuit 40 in accordance with one presently preferred embodiment of the invention that, among other things, preferably enables starting of the engine at relatively low rotational crank speed. The circuit 40 will be described primarily in reference to FIG. 2, but also in reference to FIG. 1 at times. The CDI circuit 40 includes the ignition coil having the primary winding L4 and the secondary winding L5 coupled to a gap 42 of an ignition device or spark plug for initiating ignition spark in the engine.

The charge coil L1 has one end connected to electrical ground and another end in series through a diode D1, an ignition capacitor C1, and the primary winding L4 of the ignition coil. A resistor R1 is connected across the charge coil L1, and energy induced in the charge coil L1 during cranking at engine startup is used to charge the capacitor C1. The stored energy in the capacitor C1 is discharged into the primary winding L4 of the ignition coil upon receiving a discharge signal from a trigger circuit or sub-circuit 44. Accordingly, the capacitor C1 discharges the energy or voltage stored therein through primary winding L4 wherein the voltage gets transformed to a much higher amplitude voltage through secondary winding L5 of the ignition coil to create a voltage capable of jumping the spark plug gap 42 in the form of a spark.

The trigger sub-circuit 44 includes the trigger coil L2 having one end connected to electrical ground and another end operatively connected to a control electrode or gate of an electronic switch or SCR S1 through a diode D3 and a resistor R3. A resistor R4 is connected between the gate of SCR S1 and electrical ground. The primary current conducting anode and cathode electrodes of SCR S1 are connected to capacitor C1 and to electrical ground across the series combination of the capacitor C1 and the primary winding L4. A diode D4 is connected across SCR S1 and primary winding L4. The trigger sub-circuit 44 generates the discharge signal for discharging the capacitor C1 upon receiving a signal from a timing circuit or sub-circuit 46.

The timing sub-circuit 46 includes the timing coil L3 having one end connected to ground and another end operatively connected to a control electrode or gate of an electronic switch or SCR S2 in series through a diode D2. A resistor R2 is connected between the gate of SCR S2 and electrical ground.

Figure 3:
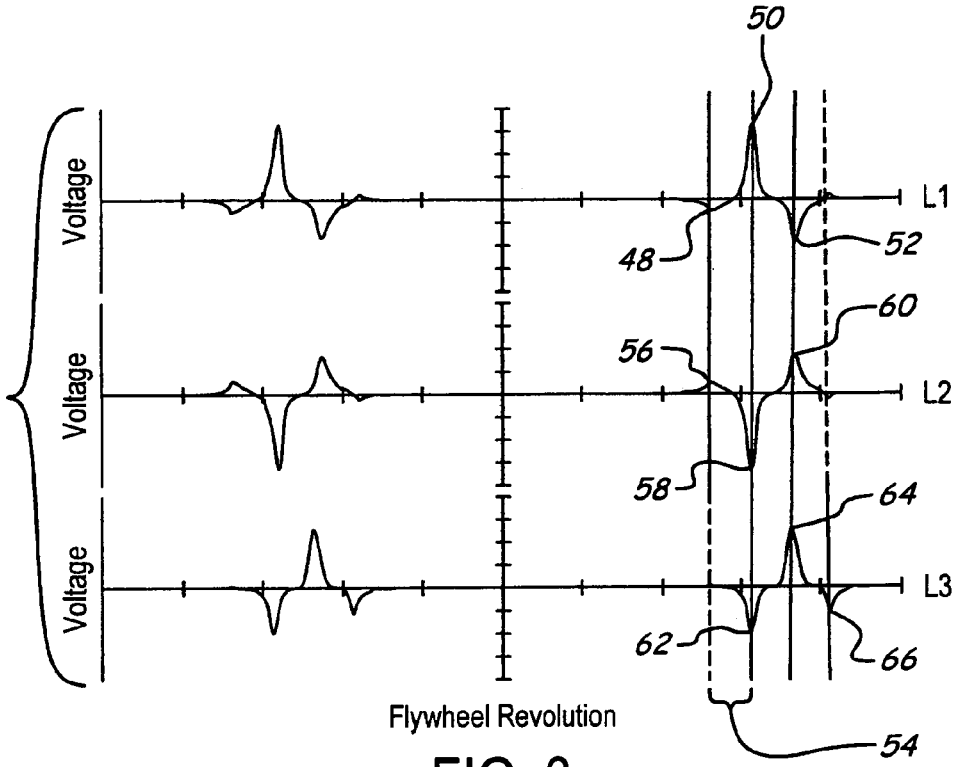
FIGS. 3–5 are signal timing diagrams useful in explaining operation of the first embodiment of the present invention and illustrating various voltage waveforms during two revolutions of the flywheel.

FIG. 3 illustrates voltage wave forms generated in coils L1, L2, and L3. One revolution of the flywheel is defined between the beginning of a first voltage signal (on the left) and a second voltage signal (on the right) for each plot of L1, L2, and L3. Accordingly, the distance between the increments along the abscissa or horizontal axis of each plot equate to about sixty degrees of revolution. Referring to the graph for the coil L1, each revolution of the permanent magnet 34 past the stator assembly 26 generates in coil L1, a first negative pulse 48, a positive pulse 50 of relatively larger magnitude, and a second negative pulse 52. The positive pulse 50 is rectified by the diode D1 and is used to charge the capacitor C1. Graphs L2, L3 illustrate the wave forms of the coils L2, L3 without modification by the circuits of the present invention. With each rotation of the permanent magnet 34 past the stator assembly 26, there are generated signals as illustrated in the graphs for coils L2 and L3 in which signal voltage is plotted on a Y-axis versus flywheel revolution on an X-axis. The graph for coil L2 illustrates that coil L2 generates a first positive pulse 56, a negative pulse 58, and a second positive pulse 60. Because the coils L2 and L3 are wound on separate legs 30, 32 of the lamstack 28 from one another, a phase separation 54 is generated therebetween as discussed above with reference to FIG. 1. Accordingly, the first positive pulse 56 of coil L2 occurs before a first negative pulse 62 of the coil L3 in accordance with the phase separation. Likewise, a positive pulse 64 and a second negative pulse 66 of the coil L3 lag respectively behind the negative pulse 58 and second positive pulse 60 of the coil L2, in accordance with the phase separation.

Moreover, the polarity of the coils L1, L2, L3 and the polarity of the diodes D1, D4 are such that the first positive pulse 56 of coil L2 is of the correct polarity to be applied to the gate of SCR S1 to trigger the SCR S1. The negative pulse 58 of coil L2 is not of the correct magnitude or polarity to trigger the SCR S1, but the positive pulse 50 of coil L1 is of the correct magnitude and polarity to be applied through the diode D1 to charge the capacitor C1, during which time the SCR S1 must be non-conducting for normal ignition operation. Upon continued rotation of the permanent magnet 34, the second positive pulse 60 of coil L2 is again of the correct polarity to trigger the SCR S1 rapidly enough to discharge the charged capacitor C1.

Figure 4:
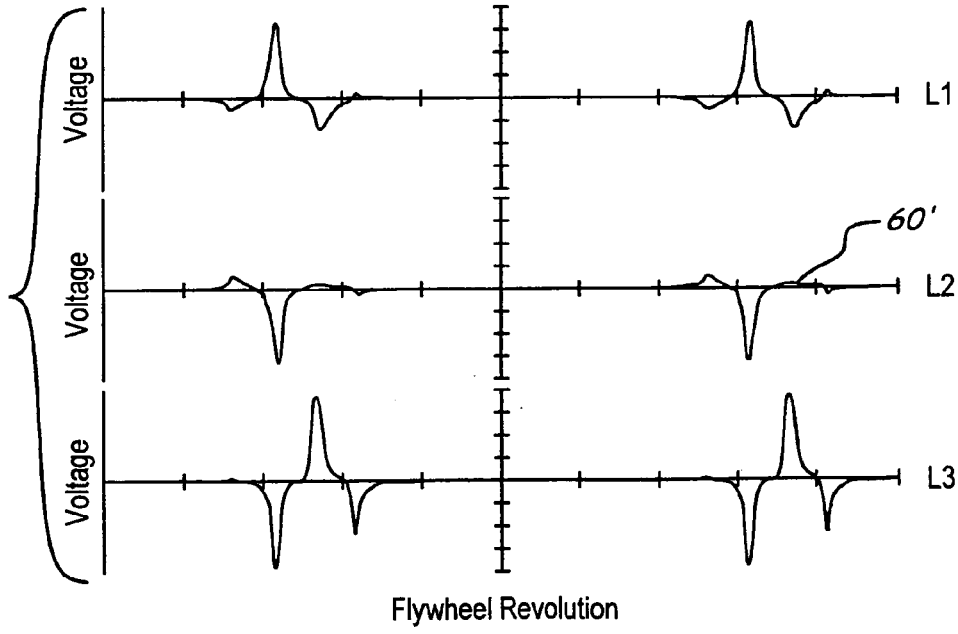

Referring again to FIG. 2, signal V1 illustrates the voltage generated by charge coil L1, which is half-wave rectified by the diode D1 and the energy of the rectified charge is stored in the capacitor C1. Similarly, the voltage wave form generated by coil L3 is half-wave rectified through the diode D2 and is applied to the gate of SCR S2, thereby turning on SCR S2. Due in part to the mechanical timing delay between coils L3 and L2, as described above, the voltage in coil L3 functions through the SCR S2 to short circuit the trigger coil L2 during occurrence of the second positive pulse thereof. Thus, the second positive pulse of the trigger signal is effectively short-circuited, thereby preventing turning on or closure of SCR S1 and discharge of the capacitor C1. In other words, when coil L3 activates SCR S2, part of the voltage wave form from coil L2, namely a second positive pulse 60' is shorted or removed, as depicted in graph L2 of FIG. 4.

Figure 5:
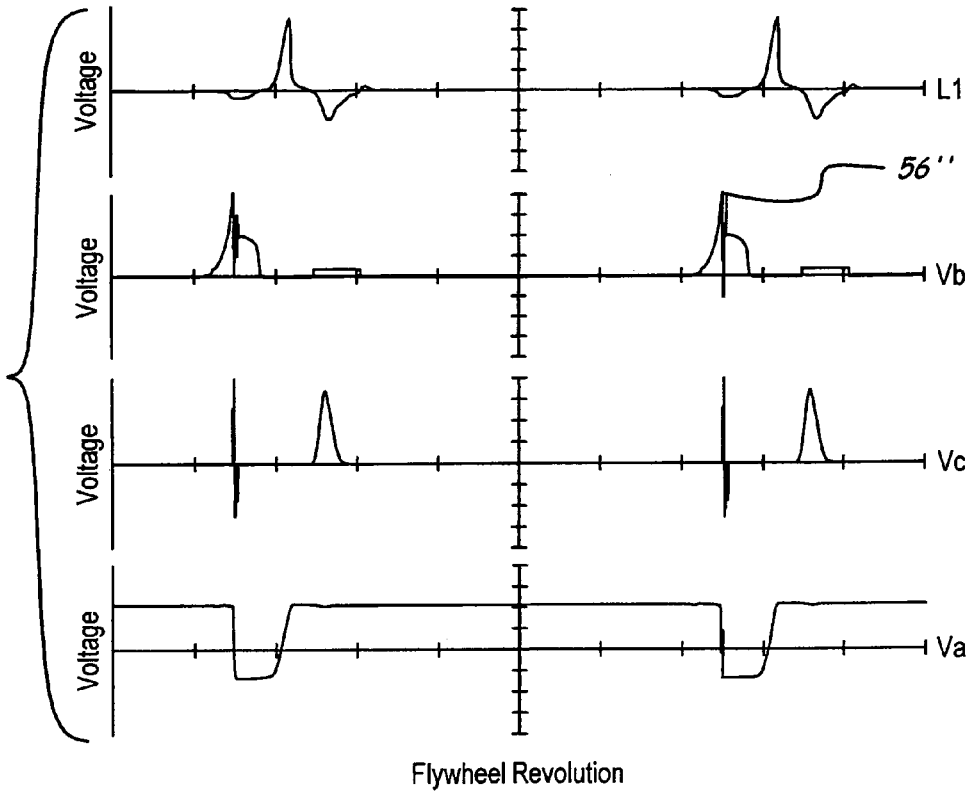

Accordingly, the ignition charge is thus further retained in the capacitor C1 until the next signal cycle of the trigger coil L2. This suppression of the second positive pulse 60 of the trigger coil L2 by SCR S2 tends to alter the leading edge of the next succeeding first positive pulse that appears on the next cycle of operation, such that a successive first positive pulse 56" has an increased width, as reflected by graph Vb of FIG. 5. This increase in width allows the ignition module to ride the slope of the first trigger pulse as engine crankshaft 24 rotational speed increases, thereby creating a timing advance. In other words, the amplitude of the leading trigger signal pulse, or first positive pulse, increases as a function of engine crankshaft 24 rotational speed. Thus, the time at which the SCR S1 gate trigger level is exceeded by the trigger signal voltage tends to advance with increasing engine crankshaft 24 rotational speed. Accordingly, ignition timing occurs at a given point at a relatively low engine speed and ignition timing advances to an earlier point at higher engine speed. Graph Vc illustrates the timing of the positive pulse 64 of coil L3, which discharges the second positive pulse 60 of the coil L2. Graph Va illustrates the timing of the discharge of the capacitor C1.

Figure 6:
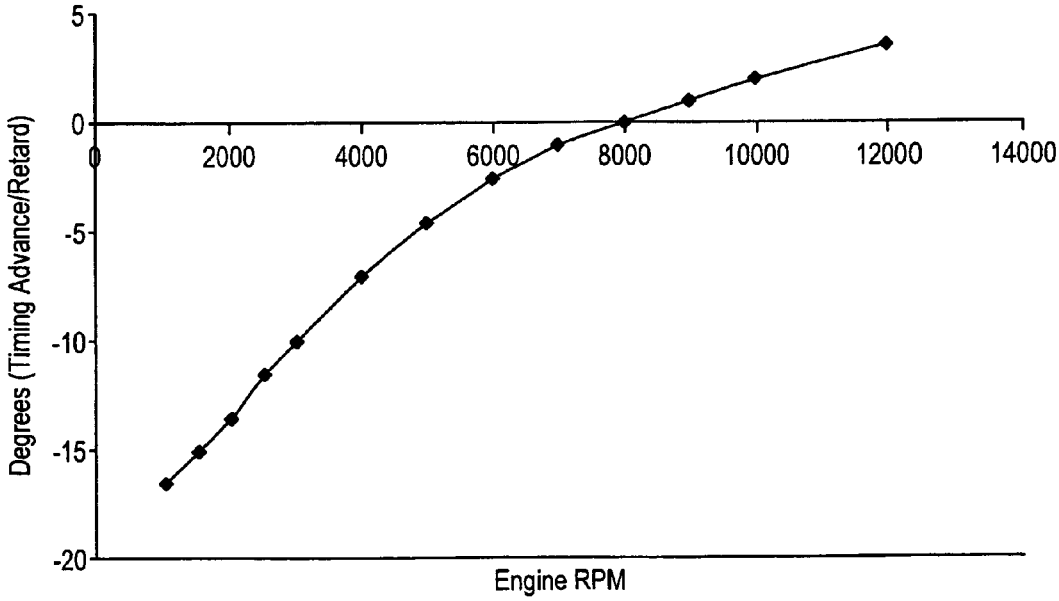
FIG. 6 is an engine timing diagram useful in explaining operation of the first embodiment of the present invention.

The timing advance of the present invention is illustrated in FIG. 6 from 0 to 12,000 RPM of engine speed. One presently preferred embodiment of the present invention provides a timing advance of about 25 degrees and produces enough energy at 350 RPM of the engine to produce a spark capable of sustaining powered operation of the engine. Also, the presently preferred embodiment keeps engine timing advancing in the working RPM range, which is approximately 7,000 to 9,000 RPM, thereby increasing the power output of the engine. Further discussion of advanced timing is included in U.S. Pat. No. 6,408,820, which is assigned to the assignee hereof and incorporated in its entirety by reference herein. Likewise, further discussion of low speed engine starting is included in U.S. Pat. No. 6,009,865, which is also assigned to the assignee hereof and incorporated in it entirety by reference herein.

As shown in FIG. 2, the timing sub-circuit requires only a few relatively inexpensive and reliable components including the timing coil L3, the diode D2, the resistor R2, and the SCR S2. Moreover, the present invention provides the features and advantages of the present invention without limiting the speed of the engine or, in other words, without speed governing the engine. If, however, speed-governing of the engine is desired, the following two embodiments of the present invention provide speed-governing by skip-spark and by timing retard.

Second Preferred Embodiment

Figure 7:
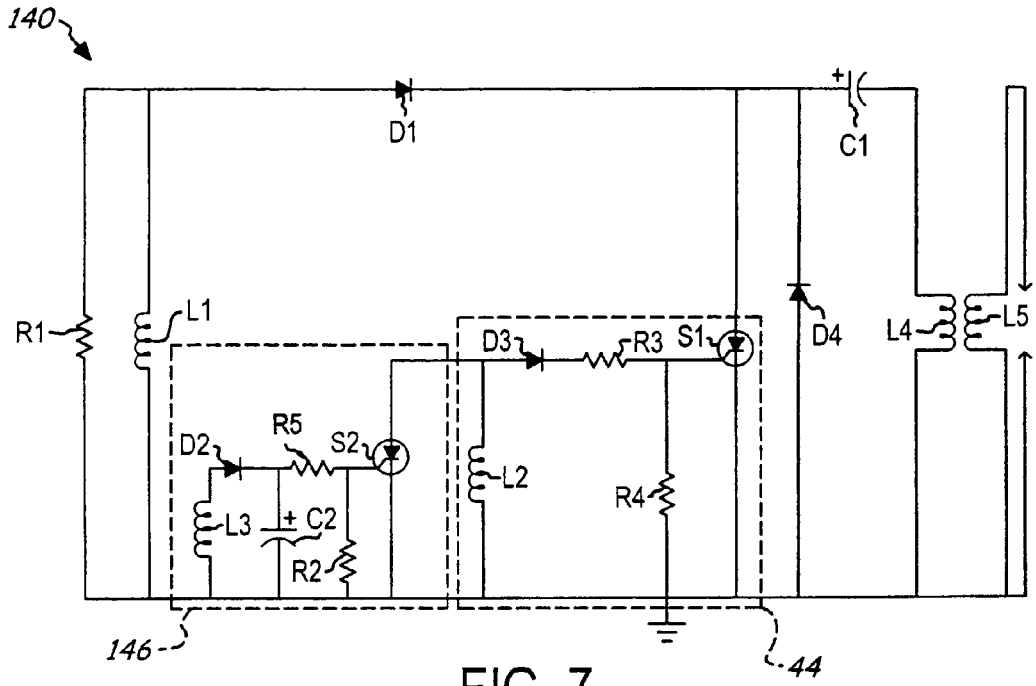
FIG. 7 is an electrical schematic diagram of an ignition circuit according to a second embodiment of the present invention.

Skip-spark speed-governing may be provided with the present invention if desired. Referring now to FIG. 7, there is illustrated a CDI circuit 140 in accordance with an alternative embodiment of the present invention. The circuit 140 is substantially the same as the circuit 40 previously described with reference to FIG. 2, with the exception of two additional components—a capacitor C2 and a resistor R5 added to a timing sub-circuit 146. Therefore, the following discussion will focus primarily on the differences therebetween. The capacitor C2 is connected in parallel across the timing coil L3, such that the capacitor C2 is operatively connected to the gate of the SCR S2. The resistor R5 is connected in series with the resistor R2 across the capacitor C2, between the capacitor C2 and the gate of the SCR S2. Thus, the combination of the resistors R2, R5 and the capacitor C2 forms an RC network to control the operation of the SCR S2.

In operation, as long as engine speed remains below a predetermined threshold that is determined by the component values of the capacitor C2 and the resistors R2, R5, there is sufficient time after the timing signal to allow the capacitor C2 to discharge through the resistors R2, R5 before generation of the trigger signal in the trigger coil L2 to allow closure of the SCR S1. However, when engine speed exceeds the predetermined threshold, there is insufficient time for the capacitor C2 to discharge between operating cycles and residual charge therefrom gates operation of the SCR S2 during at least the initial portion of the trigger signal in the trigger coil L2. This effectively short-circuits the first and second cycles of the trigger signal to prevent any closure of the SCR S1, which prevents discharging of the capacitor C1 and thereby prevents ignition at engine speeds above the threshold. Further discussion on speed governing is included in U.S. Pat. No. 5,245,965, which is assigned to the assignee hereof and incorporated in its entirety by reference herein.

Third Preferred Embodiment

Figure 8:
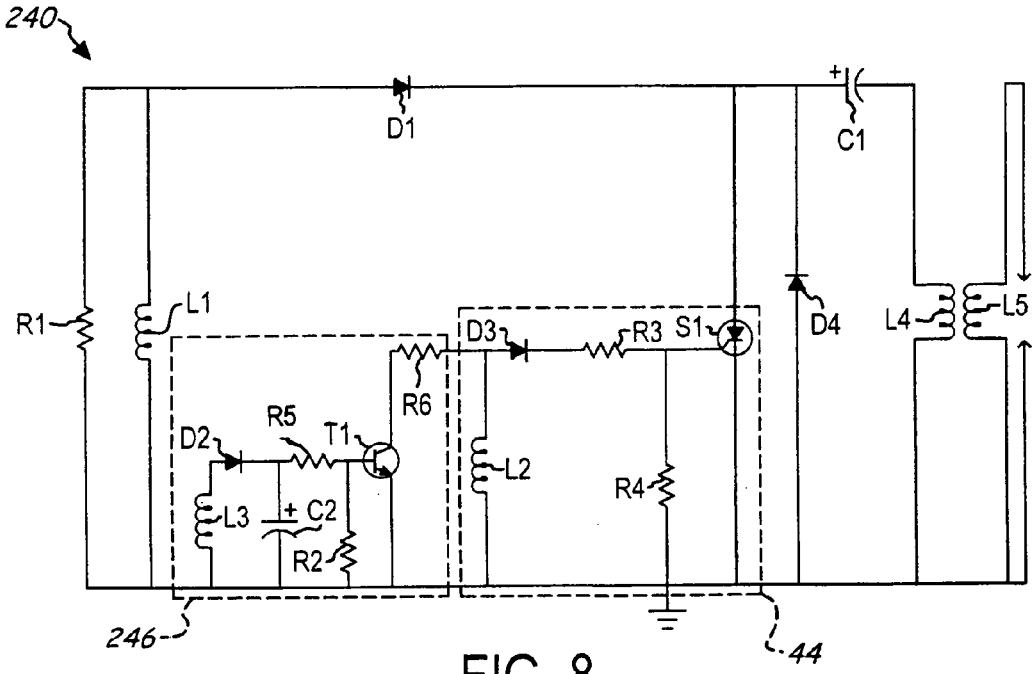
FIG. 8 is an electrical schematic diagram of an ignition circuit according to a third embodiment of the present invention.

In addition to the speed governing function of the previously described circuit, a timing retard function may be provided for excessively high engine speed operation, if desired. Referring now to FIG. 8, there is illustrated a CDI circuit 240 in accordance with another alternative embodiment of the present invention. The circuit 240 is substantially the same as the circuit 140 previously described with reference to FIG. 7, with the exception of two components—a transistor T1 (in place of SCR S2) and a resistor R6 added to a timing sub-circuit 246. Therefore, the following discussion will focus primarily on the differences therebetween. The transistor T1 has a control electrode or base connected to the junction of the resistors R2, R5 and primary current conducting electrodes (collector and emitter) connected across the trigger coil L2. The resistor R6 is connected in series with the transistor T1 between the transistor T1 and the trigger coil L2.

In operation, as long as engine speed remains below a predetermined threshold that is determined by the component values of the capacitor C2 and the resistors R2, R5, there is sufficient time after the timing signal to allow the capacitor C2 to discharge through the resistors R2, R5 before generation of the trigger signal in the trigger coil L2 to allow closure of the SCR S1. However, when engine speed exceeds the predetermined threshold, the capacitor C2 does not have time to fully discharge through the resistors R2, R5 between operating cycles. Thus, the control voltage across the capacitor C2 continues to operate the transistor T1 during the beginning of the trigger pulse of the next operating cycle, thereby delaying or retarding the spark ignition signal. When the transistor T1 finally shuts off, such as when the control voltage from the capacitor C2 decays below the predetermined threshold value of the transistor T1, the trigger pulse is allowed to increase in voltage to once again initiate an ignition.

Figure 9:
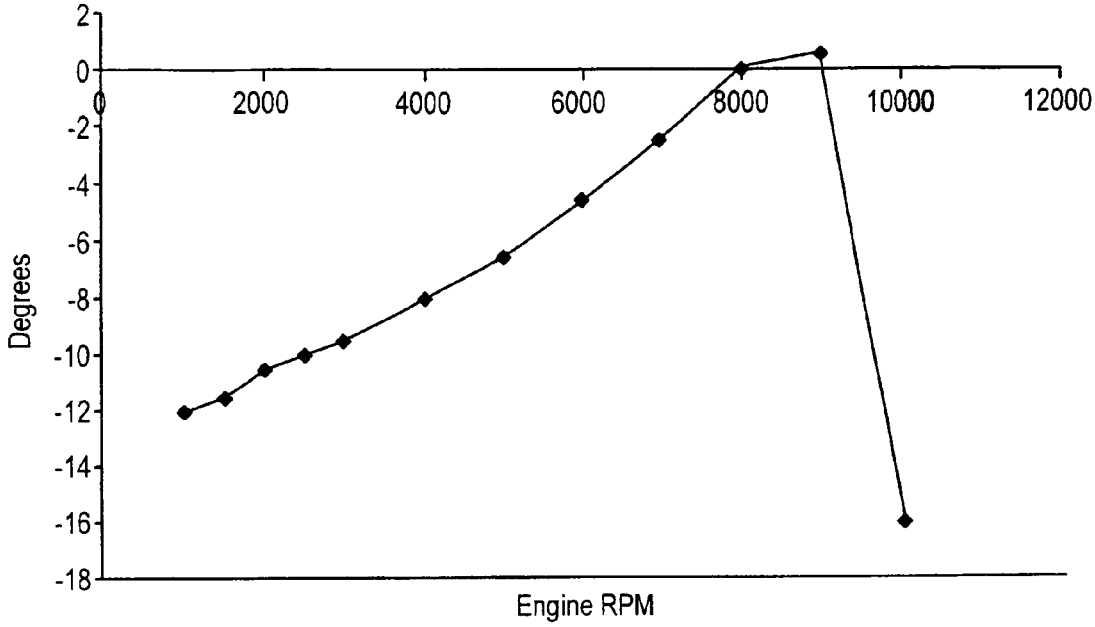
FIG. 9 is an engine timing diagram useful in explaining operation of the third embodiment of the present invention illustrated in FIG. 8.

The high-speed timing retard feature of the present invention is illustrated in FIG. 9 from 0 to 10,000 RPM of engine speed. Preferably, engine timing advance peaks between 8,000 and 9,000 RPM and then drops off rapidly between 9,000 and 10,000 RPM, as shown. A further discussion of high-speed timing retard is included in U.S. Pat. No. 6,388,445, which is assigned to the assignee hereof and incorporated in its entirety by reference herein.

Fourth Preferred Embodiment

Figure 10:
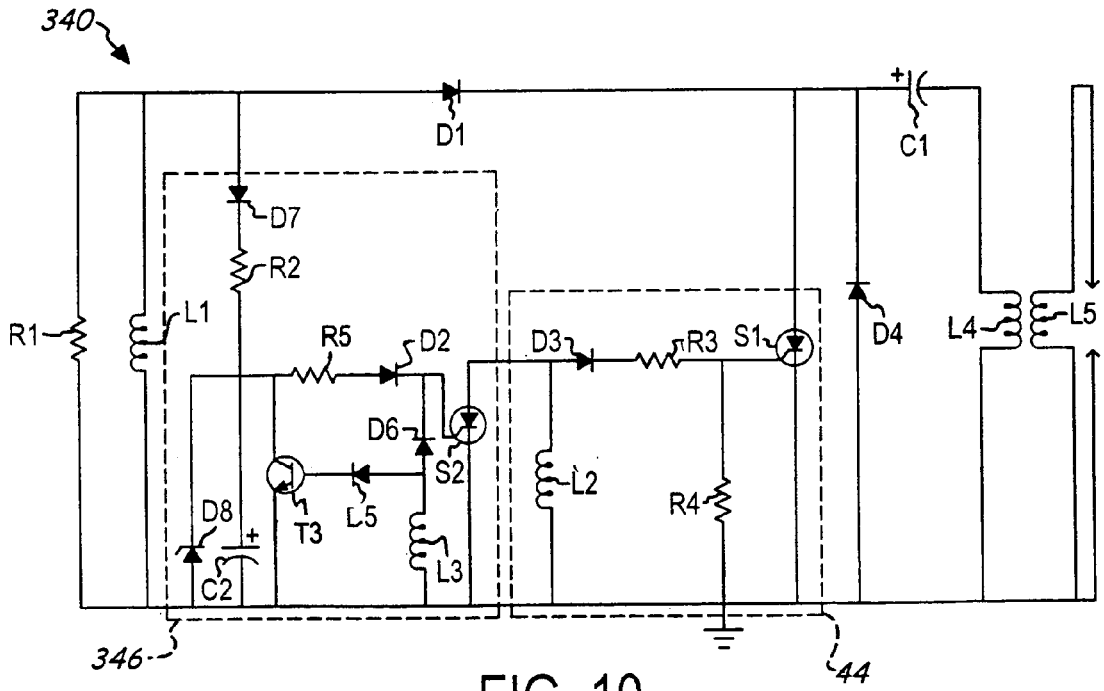
FIG. 10 is an electrical schematic diagram of an ignition circuit according to a fourth embodiment of the present invention.

Finally, the present invention may also include circuitry for preventing operation of the engine during reverse rotation of the engine crankshaft at startup. Referring now to FIG. 10, there is illustrated a CDI circuit 340 in accordance with yet another alternative embodiment of the present invention. The circuit 340 is substantially the same as the circuit 40 previously described with reference to FIG. 2, with the exception of an altered timing sub-circuit 346.

The timing sub-circuit 346 of the present embodiment includes the SCR S2 that includes an anode connected to the trigger sub-circuit 44 previously described with reference to FIG. 2, a cathode connected to electrical ground, and a gate operatively connected to the timing coil L3 with a diode D6 connected therebetween such that the cathode of the diode connects to the gate of the SCR S2. A diode D7, the resistor R2, and the capacitor C2 are connected in series across the charging coil L1. A zener diode D8 is connected across the capacitor C2 to keep the voltage thereon at a predetermined level. The capacitor C2 is also operatively connected to the gate of the SCR S2 by a series combination of the resistor R5 and the diode D2. Finally, an electronic switch or transistor T3 is connected across the capacitor C2 and is triggered by a connection of its control electrode or base to the timing coil L3 via a diode D5.

During reverse operation of the engine crankshaft 24, positive pulses from the charging coil L1 are rectified through the diode D7 and the resistor R2 and a voltage is stored on the capacitor C2. The voltage stored on the capacitor C2 is applied to the SCR S2 through the resistor R5 and the diode D2. The SCR S2 is held on for a length of time necessary to prevent the trigger pulse from the trigger coil L2 to be applied to the SCR S1 (by grounding coil L2), thereby preventing ignition in reverse. However, the additional combination of the diode D5 and the transistor T3 permits ignition in forward operation of the engine crankshaft 24. During forward operation, when the timing coil L3 generates a voltage pulse through the diode D5 to the transistor T3, the transistor T3 is put into a conductive state, thereby discharging the capacitor C2 therethrough and, thus, preventing the voltage stored on the capacitor C2 from reaching the SCR S2. Accordingly, the timing sub-circuit 346 permits ignition to occur in a forward rotation of the engine crankshaft 24 but prevents ignition from occurring in a reverse rotation.

From the above, one of ordinary skill in the art will recognize that the present invention provides a simple and cost-effective ignition system that covers a comprehensive range of features that are desirable to incorporate into a two-stroke engine, particularly for a chainsaw.

While the forms of the invention herein disclosed constitute presently preferred embodiments, many others are possible. Also, while similar reference numerals have been used amongst several different embodiments, it is to be understood that various electrical components described herein may have different values within and between the several embodiments. It is not intended herein to mention all the possible equivalent forms or ramifications of the invention. It is understood that terms used herein are merely descriptive, rather than limiting, and that various changes may be made without departing from the spirit or scope of the invention as defined by the following claims.

We claim:

1. A capacitor discharge ignition system for an engine having an ignition device, said capacitor discharge ignition system including:

an ignition coil having a primary winding and a secondary winding for coupling to said ignition device;

an ignition capacitor coupled to said primary winding;

a charge coil coupled to said ignition capacitor for generating a charge signal in synchronism with operation of said engine to charge said ignition capacitor;

a trigger circuit for generating a trigger signal in synchronism with operation of said engine and being in circuit with said ignition capacitor and said primary winding for discharging said ignition capacitor through said primary winding;

a timing circuit connected to said trigger circuit for controlling timing of said trigger signal as a function of engine speed, said timing circuit including:

a timing coil for generating a timing signal in synchronism with operation of said engine; and a switch having primary current conducting electrodes in circuit with said trigger circuit and further having a control electrode coupled to said timing coil for at least partially shorting operation of said trigger circuit.

2. The capacitor discharge ignition system as claimed in claim 1, wherein said trigger circuit includes a trigger coil that generates said trigger signal, said trigger signal being phased from said timing signal generated by said timing coil.

3. The capacitor discharge ignition system as claimed in claim 2, wherein said timing circuit further includes a capacitor connected across said timing coil, such that said capacitor discharge ignition system selectively prevents a spark ignition event at engine operating speeds above a predetermined threshold speed.

4. The capacitor discharge ignition system as claimed in claim 3, wherein said switch is a transistor, and said timing circuit further includes a resistor interposed between said transistor and said trigger circuit.

5. The capacitor discharge ignition system as claimed in claim 1, wherein said timing circuit further includes:

a capacitor operatively connected to said charge coil and to said control electrode of said switch for disabling said trigger signal to prevent reverse rotation of said engine; and a second switch having primary current conducting electrodes connected across said capacitor and further having a control electrode coupled to said timing coil for discharging said capacitor to permit forward rotation of said engine.

6. A capacitor discharge ignition system for an engine having an ignition device, said capacitor discharge ignition system including:

an ignition coil having a primary winding and a secondary winding for coupling to said ignition device;

an ignition capacitor coupled to said primary winding;

a charge coil coupled to said ignition capacitor for generating a charge signal in synchronism with operation of said engine to charge said ignition capacitor;

a trigger circuit for discharging said ignition capacitor through said primary winding and being in circuit with said ignition capacitor and said primary winding, said trigger circuit including:

a trigger coil for generating a trigger signal in synchronism with operation of said engine to trigger discharge of said ignition capacitor; and a switch having primary current conducting electrodes in circuit with said ignition capacitor and said primary winding, and further having a control electrode responsive to said trigger signal for operatively connecting said ignition capacitor to discharge through said primary winding;

a timing circuit for controlling timing of said trigger signal as a function of engine speed, said timing circuit including:

a timing coil for generating a timing signal in synchronism with operation of said engine and phased from said trigger signal of said trigger coil; and a second switch having primary current conducting electrodes in circuit with said trigger coil and further having a control electrode coupled to said timing coil for at least partially shorting operation of said trigger coil.

7. The capacitor discharge ignition system as claimed in claim 6, wherein said timing circuit further includes a combination of a diode and a resistor connected in series across said timing coil, wherein a cathode of said diode is connected to said resistor at a point connected to said control electrode of said second switch.

8. The capacitor discharge ignition system as claimed in claim 7, wherein said timing circuit further includes:

another resistor interposed between said cathode of said diode and said resistor; and a capacitor connected across said timing coil between said diode and said another resistor.

9. The capacitor discharge ignition system as claimed in claim 8, wherein said second switch is a transistor and said timing circuit further includes a resistor interposed between said transistor and said trigger circuit.

10. The capacitor discharge ignition system as claimed in claim 6, wherein said timing circuit further includes:

a capacitor operatively connected to said charge coil and to said control electrode of said second switch to prevent reverse rotation of said engine; and a third switch having primary current conducting electrodes connected across said capacitor and further having a control electrode coupled to said timing coil for discharging said capacitor to permit forward rotation of said engine.

11. A capacitor discharge ignition system for an engine having a spark plug, said capacitor discharge ignition system including:

a ferromagnetic stator having at least two legs with a plurality of coils wound around said legs;

a permanent magnet oriented in operative relationship with respect to said ferromagnetic stator, said permanent magnet being rotatable by a portion of said engine to generate pulses in said plurality of coils wound around said ferromagnetic stator;

an ignition coil amongst said plurality of coils, said ignition coil including a primary winding and a secondary winding wound around one of said at least two legs of said ferromagnetic stator, said secondary winding being adapted for connection across said spark plug;

an ignition capacitor coupled to said primary winding of said ignition coil;

a charge coil amongst said plurality of coils, said charge coil being coupled to said ignition capacitor for generating a charge signal in synchronism with operation of said engine to charge said ignition capacitor;

a trigger circuit for discharging said ignition capacitor through said primary winding and being in circuit with said ignition capacitor and said primary winding, said trigger circuit including:

a trigger coil amongst said plurality of coils for generating a trigger signal in synchronism with operation of said engine to trigger discharge of said ignition capacitor;

a switch having primary current conducting electrodes in circuit with said ignition capacitor and said primary winding, and further having a control electrode responsive to said trigger signal for discharging said ignition capacitor through said primary winding;

a voltage rectifier-divider in circuit across said trigger coil between said trigger coil and said switch, said voltage rectifier-divider including a diode having an anode connected to said trigger coil and having a cathode connected to one end of a first resistor, said first resistor being connected at another end thereof to a second resistor at a point connected to said control electrode of said switch;

a timing circuit for controlling timing of said trigger signal as a function of engine speed, said timing circuit including:

a timing coil amongst said plurality of coils for generating a timing signal in synchronism with operation of said engine and phased from said trigger signal of said trigger coil;

a second switch having primary current conducting electrodes in circuit with said trigger coil and further having a control electrode coupled to said timing coil for at least partially shorting operation of said trigger coil; and a combination of a diode and a resistor connected in series across said timing coil, wherein a cathode of said diode joins said resistor at a point connected to said control electrode of said second switch.

12. The capacitor discharge ignition system as claimed in claim 11, wherein said timing circuit further includes:

another resistor interposed between said cathode of said diode and said one end of said resistor; and a capacitor connected across said timing coil between said diode and said another resistor.

13. The capacitor discharge ignition system as claimed in claim 12, wherein said second switch is a transistor and said timing circuit further includes a resistor interposed between said transistor and said trigger circuit.

14. The capacitor discharge ignition system as claimed in claim 11, wherein said timing circuit further includes:

a capacitor operatively connected to said charge coil and to said control electrode of said second switch to prevent reverse rotation of said engine; and a third switch having primary current conducting electrodes connected across said capacitor and further having a control electrode coupled to said timing coil for discharging said capacitor to permit forward rotation of said engine.

* * * * *